US012552583B2

(12) United States Patent
Koller et al.

(10) Patent No.: US 12,552,583 B2
(45) Date of Patent: Feb. 17, 2026

(54) RESEALABLE DISPENSING ELEMENT FOR A CARDBOARD/PLASTIC COMPOSITE PACKAGE WITH A SCREW CAP ATTACHED TO IT AND METHOD FOR MOUNTING A SCREW CAP

(71) Applicant: SIG Services AG, Neuhausen am Rheinfall (CH)

(72) Inventors: David Koller, Fislisbach (CH); Sven Himmelsbach, Stein am Rhein (CH)

(73) Assignee: SIG Services AG, Neuhausen am Rheinfall (CH)

( * ) Notice: Subject to any disclaimer, the term of this patent is extended or adjusted under 35 U.S.C. 154(b) by 0 days.

(21) Appl. No.: 18/870,800

(22) PCT Filed: Jul. 18, 2023

(86) PCT No.: PCT/EP2023/069937
§ 371 (c)(1),
(2) Date: Dec. 2, 2024

(87) PCT Pub. No.: WO2024/017898
PCT Pub. Date: Jan. 25, 2024

(65) Prior Publication Data

US 2025/0256892 A1 Aug. 14, 2025

(30) Foreign Application Priority Data

Jul. 20, 2022 (DE) ..... 10 2022 118 177.4

(51) Int. Cl.
*B65D 41/34* (2006.01)
*B65D 5/74* (2006.01)

(52) U.S. Cl.
CPC ..... *B65D 41/3409* (2013.01); *B65D 5/746* (2013.01)

(58) Field of Classification Search
CPC .... B65D 5/747; B65D 5/068; B65D 2401/30; B65D 41/3409; B65D 41/3447; B65D 5/746; B65D 51/226
See application file for complete search history.

(56) References Cited

U.S. PATENT DOCUMENTS

2019/0193894 A1* 6/2019 Hauser ..... B65D 5/748
2021/0024258 A1* 1/2021 Krautkramer ..... B65D 41/3409
(Continued)

FOREIGN PATENT DOCUMENTS

CA 2138321 A1 6/1995
CN 101316764 A 12/2008
(Continued)

*Primary Examiner* — Shawn M Braden
(74) *Attorney, Agent, or Firm* — The Webb Law Firm

(57) ABSTRACT

A resealable dispensing element for a composite package is shown and described including a main body with a flange and a hollow cylindrical spout with at least one outer thread, an opening means guided movably in the spout for opening the composite package and a resealable screw cap, having an anchor ring. The screw cap serves to drive the opening means when the composite package is opened for the first time and wherein the screw cap and the anchor ring are connected by a plurality of breakable material bridges or at least by a material anchorage for connection to the main body. The main body on the spout has at least one circumferential web for securely holding the anchor ring and wherein the anchor ring has on its inside a circumferential retaining web shaped such that it corresponds with the circumferential web, as well as a method for mounting the screw cap for such a dispensing element. In order to reliably rule out tilting of the anchor ring during the mounting process of the dispensing element, it is provided that the main body has a plurality of vertical guide ribs arranged distributed over the circumference on the spout between the outer thread and the circumferential web for uniformly
(Continued)

stretching the anchor ring when the screw cap is applied during the mounting of the dispensing element.

16 Claims, 5 Drawing Sheets

(56) References Cited

U.S. PATENT DOCUMENTS

| | | | | |
|---|---|---|---|---|
| 2024/0140644 | A1* | 5/2024 | Himmelsbach ..... | B65D 5/068 |
| 2024/0150068 | A1* | 5/2024 | Himmelsbach ..... | B65D 5/748 |

FOREIGN PATENT DOCUMENTS

| | | | |
|---|---|---|---|
| CN | 113968415 | A | 1/2022 |
| CN | 114746343 | A | 7/2022 |
| DE | 202021103289 | U1 | 8/2021 |
| EP | 1533240 | A1 | 5/2005 |
| EP | 1795456 | A1 | 6/2007 |

* cited by examiner

RESEALABLE DISPENSING ELEMENT FOR A CARDBOARD/PLASTIC COMPOSITE PACKAGE WITH A SCREW CAP ATTACHED TO IT AND METHOD FOR MOUNTING A SCREW CAP

CROSS-REFERENCE TO RELATED APPLICATIONS

This application is the United States national phase of International Patent Application No. PCT/EP2023/069937 filed Jul. 18, 2023, and claims priority to German Patent Application No. 10 2022 118 177.4 filed Jul. 20, 2022, the disclosures of which are hereby incorporated by reference in their entireties.

BACKGROUND OF THE INVENTION

Field of the Invention

The invention relates to a resealable dispensing element for a cardboard/plastic composite package, comprising:

- a main body with a flange and a hollow cylindrical spout with at least one outer thread,
- an opening means guided movably in the spout for opening the composite package and
- a resealable screw cap, having an anchor ring, wherein the screw cap serves to drive the opening means when the composite package is opened for the first time and wherein the screw cap and the anchor ring are connected by a plurality of breakable material bridges or at least by a material anchoring for connection to the main body, wherein the main body on the spout has at least one circumferential web for securely holding the anchor ring and wherein the anchor ring has on its inside a circumferential retaining web shaped such that it corresponds with the circumferential web, as well as a method for mounting the screw cap for such a dispensing element.

DESCRIPTION OF RELATED ART

A generic resealable dispensing element is known from DE 20 2021 103 289 U1 attributable to the applicant.

Such dispensing elements are integrated as part of the gable of the composite package for simplified handling during pouring and the possibility of resealing composite packages. Another known dispensing element is shown, for example, in EP 1 795 456 A1. The hollow cylindrical cutting element opens the previously gas-tight composite package for the first time, thus forming a dispensing opening, wherein the screw cap enables the now open composite package to be resealed. The cutting element, which is movably guided in the spout, is provided with force transfer elements and is thereby driven by corresponding force transmission elements on the screw cap. During the first opening process, the cutting element approaches the region of the composite package to be opened and after the first contact of the two elements, at least one cutting tooth of the cutting element separates the composite package in the region of a weakening zone. The movement path that the at least one cutting element travels corresponds to the weakening zone.

The opening process can be divided into the following sections, for example. The approach of the cutting element mentioned above can also be omitted if the two elements already touch in the assembled state. The cutting element then moves through the composite material and separates it with the cutting tooth along a cutting line. This separation process is a combination of separation, plastic deformation and material displacement, wherein a uniform and controlled application of the forces is advantageous. As soon as a large part of the circumference has been separated, the cutting element starts to fold the freely cut composite material or a closure part as part of the main body to the side and thus release the spout for the content. Folding away is carried out with the aid of the remaining piece of the weakening zone, which has not been separated, as a pivot axis, wherein first the cutting tooth and then the outer side of the cutting element exert force on the closure part during the course of folding away and thus press it to the side. After the dispensing element has been completely opened, the piece of composite material or the closure part is approximately parallel to the central axis along the outer wall of the screwed-in cutting element. This reliably guarantees free pouring of the product contained in the composite package.

Dispensing elements with such a closure part are mainly, but not exclusively, used in aseptic packages. In this case, previously sterilized foodstuffs are packaged under aseptic conditions in similarly sterilized packaging materials in order then to obtain so-called aseptic packages. Apart from the question of aseptics, there are various types of composite packages into which a dispensing element according to the invention can be integrated.

In a first manner, the dispensing element is an integral part of the composite package, which is introduced during the manufacturing process of the same. For this purpose, cutouts of composite material, which are initially shaped into package sleeves by sealing the longitudinal seam, are usually firstly connected to the dispensing element in a so-called "form fill and seal" packaging machine (FFS). These semi-shaped products, which are open on one side, are then filled with the product and sealed thereafter. The first step can be provided in different ways: For example, the flange can be connected to one side of the package sleeve by a further plastic element, which is injection-moulded directly in the packaging machine. The flange can also be welded directly to the package sleeve or even adhered to it without using an additional plastic element.

In a second manner, an initially completely sealed composite package is manufactured, wherein a punched hole is present in the composite package, usually in the gable region, into which a dispensing element is introduced. The dispensing element is usually inserted by welding the flange to at least one layer of the composite material. Alternatively, these parts can also be adhered. This second type of composite package is also characterized in particular in that the insertion of the dispensing element can be independent of the manufacture of the composite package. The manufacture of the hole and also the insertion of the dispensing element can therefore take place in each case before, during or after the manufacture of the composite package itself. Both steps are preferred before manufacture in order not to make the packaging machines themselves unnecessarily complicated. This arrangement of the production steps also represents the simplest possibility of inserting the dispensing element into the punched hole from the inside.

Another type concerns the composite packages with what is known as an overcoated hole (OCH=OverCoated Hole). In this case, the punched hole is coated on one or both sides with liquid plastic and the barrier layer before folding and manufacturing of the package sleeve, resulting in the package being sealed in a gas-tight manner again in the area of the hole. In composite packages of this type, the weakening zone is formed by the plastic layer(s), wherein the cutting on the first opening of a package of this type takes place close to the edge of the overcoated hole.

Composite packages of this type are normally produced in one of two types of packaging machines. In this first alternative, an endless web of sterilized composite material is shaped into a tube and sealed, after which it is filled with the similarly sterilized product and sealed and cut at equal distances transversely thereto. The resulting "package pads" are then formed along the pre-folded edges into parallelepipedic packages. The sealing seam formed during transverse sealing in the gable region is usually referred to as a gable seam. The second alternative uses cut-outs of composite material, which are first shaped into package sleeves by sealing the longitudinal seam and then shaped on mandrels into package bodies open on one side, then sterilized, filled and lastly sealed and finally shaped.

Generally, the gable region can be designed differently, such as for example as a parallel surface to the base surface (flat gable package), as a surface formed at least partially at an angle to the base surface (oblique gable package) or also as a saddle roof with two opposing, oblique surfaces ('gable top' package). It is also possible to design the gable as a blunt pyramid. In this case, the flange of the dispensing element is square and has sealing surfaces running downwards in a pyramidal stump shape at the edges, which are sealed with the composite material of the package, wherein four protruding ears are created, which are folded over on the gable sides and sealed there.

The precise layer structure of the composite material can vary depending on requirements, but at least consists of a carrier layer of cardboard and cover layers of plastic. In addition, a barrier layer for example, aluminium (Al), polyamide (PA) or ethylene vinyl alcohol copolymer (EVOH) may be necessary in order to ensure an increased barrier effect against gases, in particular oxygen, for aseptic products and also against light in the case of aluminium. For this reason, such composite packages are also referred to as cardboard/plastic composite packages. If the dispensing element is integrated as part of the composite package, it should have a similarly strong barrier effect against gases and light as the composite material used. At the same time, cheap materials should of course be used that are easy to recycle together. This also applies in particular to the materials of the dispensing elements used.

The dispensing elements explained in more detail above thus generally consist of three individual elements, namely the main body, the opening means and the screw cap. Before sealing with the composite package, it is therefore necessary to assemble dispensing elements consisting of the individual elements. For this purpose, the opening means is introduced into the main body from above and inserted into it until the upper edge of the spout of the main body and the upper edge of the opening means run roughly in one plane. The opening means is either screwed in or pressed in linearly. The screw cap is then pressed from above onto the main body in a predetermined orientation, wherein both the anchor ring and the screw cap are widened with their hollow cylindrical thread region in order to be able to be moved over the outer thread of the hollow cylindrical spout. This process is also known as bouncing.

If the main body on the outer circumference of its hollow cylindrical spout below the outer thread has a significantly smaller diameter than the outer diameter of the outer thread, it can happen during the bouncing process that the anchor ring tilts during the bouncing process after passing the outer thread of the spout. In this case, the screw cap of the dispensing element slides in front of or behind a part of the anchor ring such that it is wedged in a plane running obliquely to the flange of the main body. However, a dispensing element of this type can no longer perform its function and must instead be ejected and disposed of as scrap.

SUMMARY OF THE INVENTION

Based on this, the object underlying the present invention is to design and further develop the dispensing element mentioned at the outset and previously described in more detail such that tilting of the anchor ring is reliably ruled out during the mounting process of the dispensing element.

This object is achieved in the case of a dispensing element with the features as described herein in that the main body has a plurality of vertical guide ribs arranged distributed over the circumference on the spout between the outer thread and the circumferential web for uniformly stretching the anchor ring when the screw cap is applied during the mounting of the dispensing element. According to the invention, the anchor ring is evenly widened during the mounting process of the screw cap, wherein the anchor ring is centred during the mounting. This expands the anchor ring at the same time as the screw cap. The anchor ring cannot move inwards. The clamping in the mounting tool also prevents the anchor ring from slipping outwards. In this way, an offset of the anchor ring and screw cap relative to each other is reliably ruled out.

According to a further preferred configuration of the invention, it is provided that the overlap of the circumferential web and the circumferential retaining web is 0.5 to 0.7 mm with respect to the respective radius. This dimension has been proven to ensure reliable connection of the anchor element onto the main body without making assembly unnecessarily difficult. Overlap refers to the difference between the inner radius of the circumferential retaining web and the outer radius of the circumferential web. The outer radius is measured outside any existing recesses.

Free rotation of the anchor ring is also achieved by the interaction of the circumferential web and the circumferential retaining web. Free rotation is thereby not only required when unscrewing the screw cap, but also very helpful in order to be able to rotate the screw cap freely in its unfolded state so that the pouring stream of the product is not obstructed by the screw cap.

A further configuration of the invention provides that the upper edges of all lateral guide surfaces of the vertical guide ribs lie on a common circular line that is as large as the outer circumference of the outer thread. This reliably ensures that an even expansion of the anchor ring after it has passed the outer thread of the spout of the main body is reliably guaranteed. It is expedient to provide additional support from the inside so that the anchor ring cannot deviate (unevenly) inwards during the mounting process in the event of force application from above.

According to a further preferred embodiment of the invention, it is provided that the lateral guide surfaces run purely axially below the circular line up to the circumferential web. This allows a smooth course during the axial mounting movement.

Another preferred embodiment of the invention provides that the outer radius of the circumferential web is a maximum of 5%, particularly preferably a maximum of 4%, greater than the radius of the circular line.

In a further configuration of the invention, it is provided that the main body has at least six vertical guide ribs arranged evenly distributed over its circumference.

According to a further preferred embodiment of the invention, the main body has ten to twenty-four vertical guide ribs arranged distributed over its circumference.

According to a further preferred embodiment of the invention, it is provided that a slot without material bridges is provided between the anchor ring and the cover element and that the anchor ring has a tether connected in one piece to the cover element as a material anchorage. This design reliably ensures that the screw cap cannot come loose from the dispensing element and thus from the composite package after unscrewing.

According to a further configuration of the invention, a hollow cylindrical cutting element with at least one cutting tooth is provided as the opening means. This well-known design has proven itself to guarantee a reliable initial opening of a composite package when the screw cap is screwed on for the first time. Preferably, the cutting element thereby has an outer thread on its outer circumference, which interacts with a corresponding inner thread in the hollow cylindrical-like spout of the main body and enables a helical movement of the cutting tooth.

In a further preferred embodiment of the invention, it is provided that a circumferential strip is provided below the anchor ring, which is connected to the anchor ring arranged above it via a plurality of breakable material bridges arranged distributed over the circumference and serves as a tamper-evident seal.

For this purpose, it is particularly advantageous if the circumferential strip on its inside has a plurality of stop elements arranged distributed over the circumference, which hook with vertical locking elements arranged correspondingly over the circumference of the main body when the screw cap is opened for the first time, such that the material bridges break and visually indicate an opening of the composite package that has already taken place.

According to a further preferred embodiment of the invention, the circumferential web of the main body has recesses arranged distributed over its circumference, which in the assembled state of the dispensing element are in each case above the stop elements of the tamper-evident strip. This makes it easier to mount the dispensing element and reliably prevents premature breakage of the material bridges during the mounting process.

According to a further preferred configuration of the invention, the vertical locking elements are arranged in extension of the vertical guide ribs. This is expedient for manufacturing the screw cap in the injection moulding tool.

The invention further relates to a method for mounting the screw cap for a dispensing element, which is characterized by the following steps:

- grasping the screw cap around its circumference by means of a retaining device to achieve support around the entire 360° of the circumference,
- aligning the screw cap by rotating with respect to the main body and
- moving the clamped screw cap and main body relatively axially until the end position is reached.

Preferably, the retaining device thereby has a cavity, wherein the screw cap is moved axially into this cavity before the final assembly and clamped there. In this way, the dispensing element according to the invention is mounted with optimum support of the dispensing element, such that tilting of the anchor ring during mounting is reliably ruled out. Damage to or displacement of the anchor ring is reliably avoided by means of a staggered process in which the screw cap is first moved to its end position and then the retaining device is closed.

Finally, it is preferably provided that the screw cap is clamped only in axial regions without screw threads or webs from the outside. In this way, the material of the screw cap can deviate outwards in the non-supported regions, i.e. those with screw thread or webs, while remaining supported in the remaining regions.

BRIEF DESCRIPTION OF THE DRAWINGS

The invention will be explained in more detail below with reference to a drawing which represents only one preferred exemplary embodiment, in the drawing is shown, FIG. 1 a dispensing element according to the invention in perspective view, FIG. 2 the dispensing element according to the invention from FIG. 1 in plan view, FIG. 3 a main body of the dispensing element according to the invention in perspective view from above, FIG. 4 the screw cap of the dispensing element according to the invention in a vertical section, FIG. 5A the dispensing element according to the invention from FIG. 2 in the vertical section along the line VA-VA at the beginning of mounting, FIG. 5B a detailed view of the vertical section from FIG. 5A, FIG. 6A the dispensing element according to the invention from FIG. 2 in the vertical section along the line VA-VA during mounting, FIG. 6B a detailed view of the vertical section from FIG. 6A, FIG. 7A the dispensing element according to the invention from FIG. 2 in the vertical section along the line VA-VA after mounting is completed and FIG. 7B a detailed view of the vertical section from FIG. 7A.

DESCRIPTION OF THE INVENTION

Figure 1:
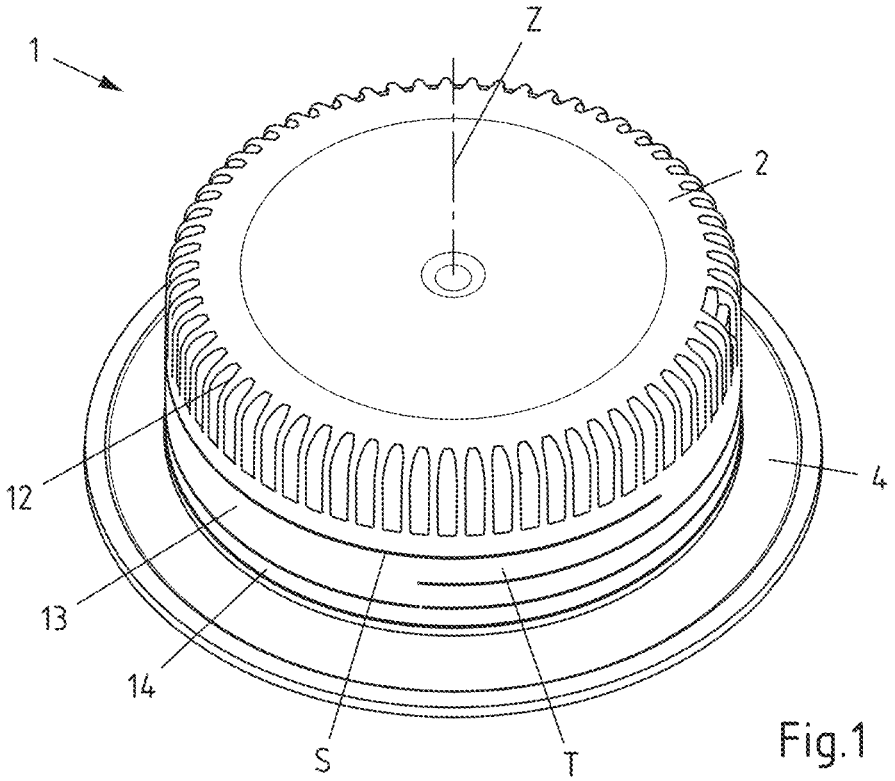

A preferred exemplary embodiment of a dispensing element 1 according to the invention is shown in the drawing. FIG. 1 shows a first dispensing element 1 in closed state with a vertical axis Z without composite package P. A resealable screw cap 2, which is used for the first opening and for resealing the composite package P, is located on a main body 3, from which in FIG. 1 only one circumferential flange 4 is visible, which is used for connection with and integration into the composite package (not shown). In the plan view of FIG. 2, a section line VA-VA is also drawn in.

Figure 2:
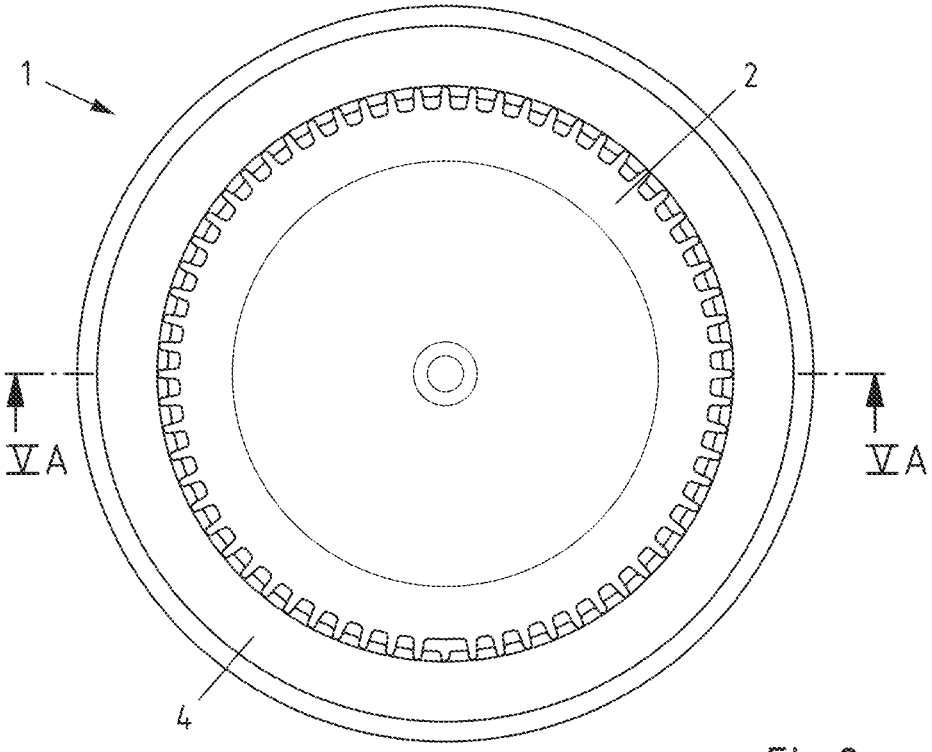
Figure 3:
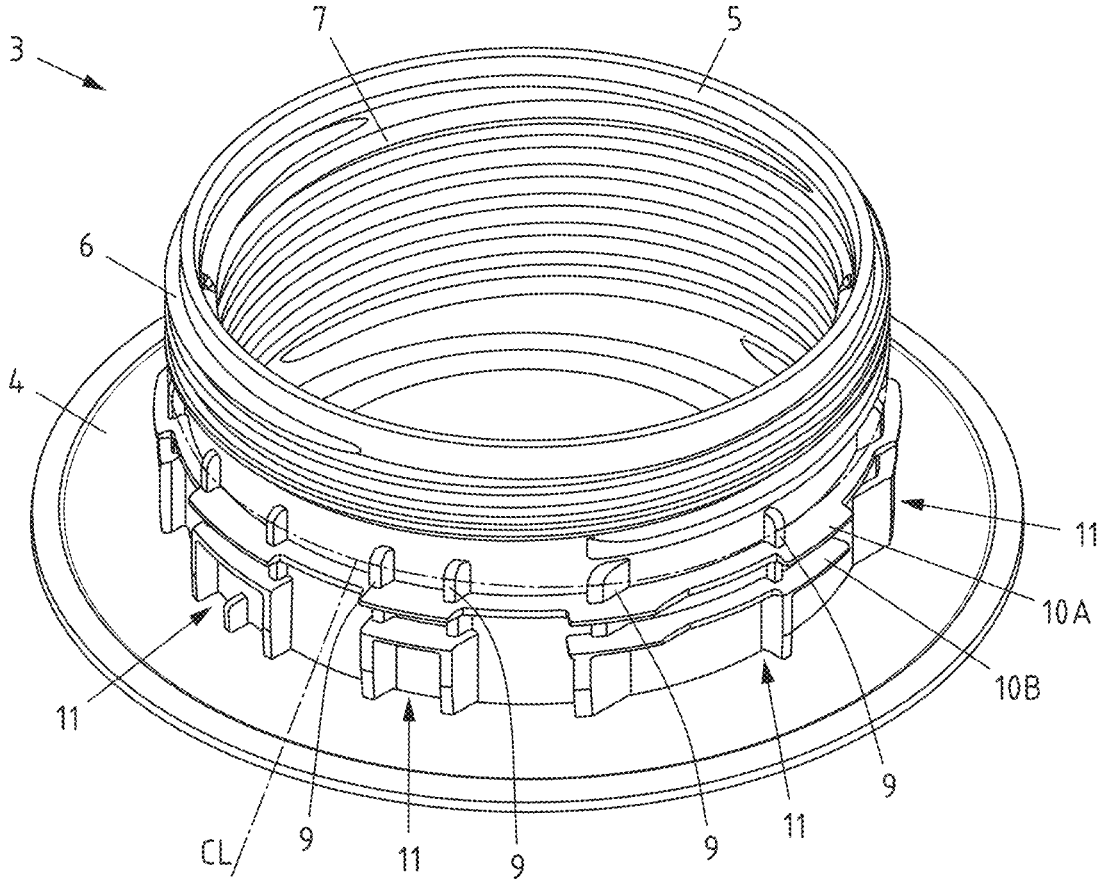

The main body 3 of the dispensing element 1 according to the invention, which was concealed in FIGS. 1 and 2 by the screw cap 2, is shown individually in FIG. 3 in a perspective view from above. It essentially consists of a horizontal flange 4, the outer edge of which is sealed with the package edge of a punched opening in a composite package, as described in more detail below, and a hollow cylindrical spout 5, which has an outer thread 6 and an inner thread 7. The inner thread 7 serves to accommodate a cutting element 8, which, however, is only recognizable in FIG. 5A and is also described in more detail there.

The spout 5 has a plurality of vertical guide ribs 9 arranged on its outer circumference distributed over the circumference below the outer thread 6 according to the invention. It can be seen that the depth of the vertical guide ribs 9 corresponds approximately to the depth of the outer thread 6. The upper edges of all lateral guide surfaces of the vertical guide ribs 9 lie on a common circular line CL and ensure during the mounting process that the screw cap 2 is evenly widened and centred during the bouncing process after passing the outer thread 6 of the spout 5. In addition to the vertical guide ribs 9, a circumferential web 10A can be found in the region of these guide ribs 9, which is not designed to be rotationally symmetrical, but instead has recesses that are not described in more detail in some regions. Parallel to this circumferential web 10A and below this, web sections 10B can also be seen which have the same outer contour as the circumferential web 10A.

A plurality of vertical webs can be seen below the vertical guide ribs 9 and in extension thereto as well as below the web sections 10B, which serve as locking elements 11. The function of these locking elements 11 is described in more detail further below in conjunction with the description of FIG. 4. In the exemplary embodiment shown and preferred in this respect, the screw cap 2 has, in addition to the actual cover element 12, an underlying anchor ring 13 and in turn a strip 14 arranged underneath, which is also clearly visible from the outside in the perspective view of FIG. 1.

In the exemplary embodiment represented and preferred in this respect, the cover element 12 is connected to the anchor ring 13 via a one-piece Tether T, i.e. a "retaining strip". For this purpose, the screw cap 2 is provided with at least one slot S by a circumferential slit blade. In the exemplary embodiment shown and preferred in this respect, two slots S are present, as is visible from FIG. 1. To produce them, two cuts are made in parallel planes. As a result, the screw cap 2 is connected via a tether T, wherein both tether arms are connected to the anchor ring 13 in one piece. In FIG. 1, however, only the front "end" of the Tether T is visible. However, it is also possible to provide only a single slot if only one attachment to the anchor ring is desired via a single end of the tether strip. In this case, the one cut runs over the circumference at least partially in a helix shape such that the two ends of this slot are at different heights relative to the vertical axis Z.

Figure 4:
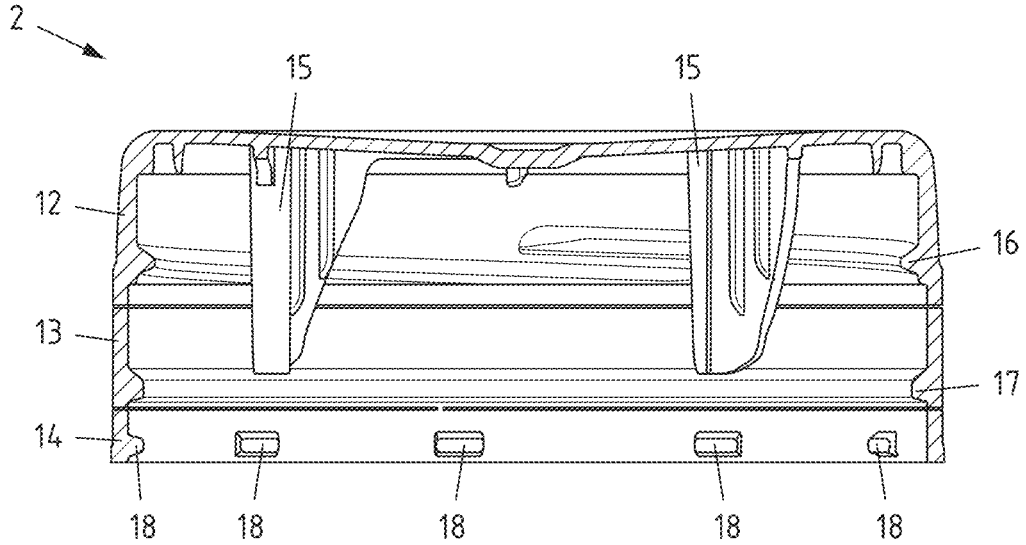

FIG. 4 shows a vertical section through the screw cap 2 of the dispensing element 2 according to the invention, wherein the cover element 12, the anchor ring 13 and the strip 14 of the screw cap 2 are clearly recognizable. The two force transmission elements 15, which extend downwards from the straight region of the cover element 12, are also particularly clearly visible here. Furthermore, an inner thread 16 can be recognized inside the cover element 12, which corresponds to the outer thread 6 of the spout 5 of the main body 3. In addition, FIG. 4 shows that the anchor ring 13 has a circumferential retaining web 17 in its lower region. This is described in more detail below.

Finally, FIG. 4 clearly shows that the strip 14 serving as a tamper-proof seal has on its inside a plurality of stop elements 18 arranged distributed over the circumference, the arrangement of which is selected in such a way that in the assembled state of the dispensing element 1 according to the invention they lie in the region of the locking elements 11 and below the webs 10 of the main body 3 and engage with the locking elements 11 when the screw cap 2 is opened for the first time, so that rotation of the circumferential strip 14 is reliably excluded. The locking elements 11 are arranged in such a way that they, as can be seen clearly in FIG. 3, are below the recesses of the webs 10A and 10B. The anchor ring 13 and strip 14 are connected to one another in a single piece via small material bridges (not shown). During the first opening process, these material bridges break up due to the blocking catching of the circumferential strip 14 and thus signal to the consumer that the dispensing element 1 has already been opened. A tamper-evident seal formed in this way is also known as the "Tamper Evident Element".

Figure 5A:
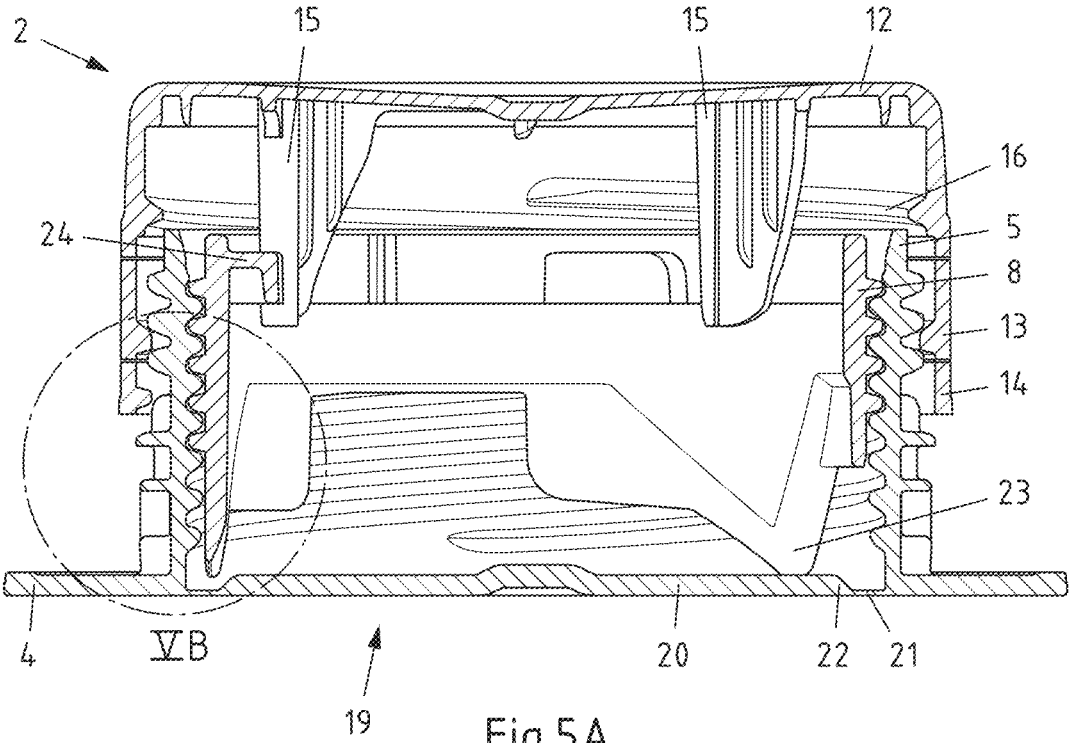

The further FIGS. 5A to 7B serve to make clear the sequence of mounting of the dispensing element 1. FIG. 5A thereby firstly shows the beginning of the mounting with the screw cap 2 just placed on, FIG. 6A a further intermediate position of the screw cap 2 and FIG. 7A the fully assembled dispensing element, sealed in an opening of a composite package P.

FIG. 5A shows the entire dispensing element 1 in the vertical section along the section line VA-VA from FIG. 2. The main body 3 sealed with the flange 4 at the circumferential edge of an opening in a composite package P further has a closure part 19 formed in the spout 5. The closure part 19 has a central region 20, which closes the majority of the dispensing opening, and an annular weakening zone 21, which connects to the spout 5, as well as a conical annular intermediate region 22, which extends between the weakening zone 21 and the central region 20. The chamfering of the intermediate region 22 compensates for the thickness difference between the central region 20 and the weakening zone 21.

Figure 5B:
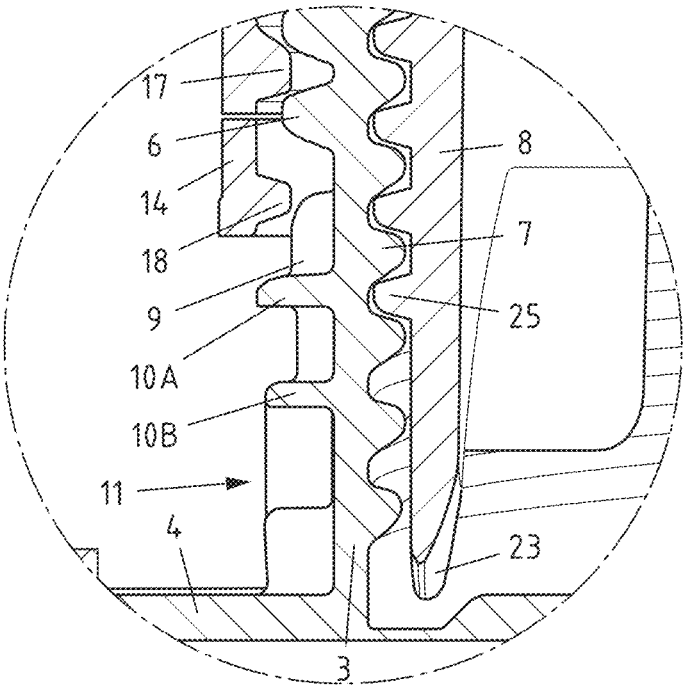

The region in the dashed circle VB from FIG. 5A is shown enlarged in FIG. 5B. In FIG. 5A, the position of the screw cap 2 is shown with reference to the main body 3 and the opening means inserted therein and designed as a cutting element 8 in the represented and in this respect preferred exemplary embodiment at the start of the mounting of the dispensing element 1 (bouncing process). The inner thread 16 of the cover element 12 is still arranged above the main body 3 and cutting element 8. However, it can be seen that the circumferential retaining web 17 of the anchor ring 13 has already partially passed the outer thread 6 of the spout 5 and the representation of the enlargement in FIG. 5B clearly shows that the inner diameter of the retaining web 17 is smaller than the outer diameter of the outer thread 6. However, a brief deformation of both elements is possible due to the plastic material used, wherein the circumferential retaining web 17 is widened. However, this expansion does not occur evenly over the circumference of the retaining web 17 due to the recesses present in the web 10A.

Figure 6A:
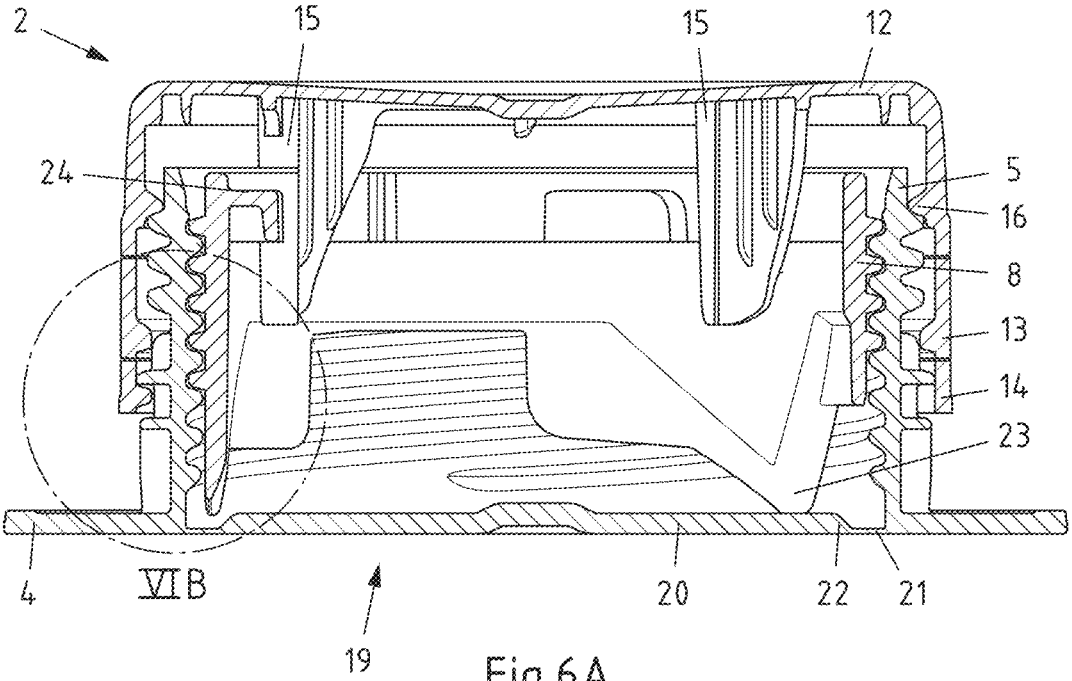
Figure 6B:
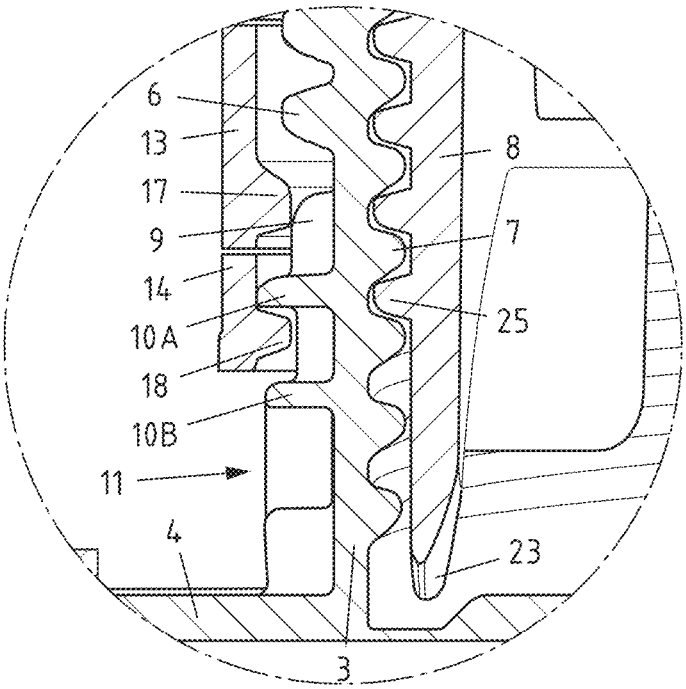

A further "snapshot" of the mounting process of the dispensing element 1 according to the invention is shown in FIGS. 6A and 6B, in which the inner thread 16 of the cover element 12 already comes into contact with the outer thread 6 of the spout 5. The anchor ring 13 has already passed the thread 6 with its circumferential retaining web 17 and it can be clearly seen in FIG. 6B that the geometric configuration of the vertical guide rib 9, which is rounded in the upper region, ensures that the circumferential retaining web 17 widens evenly in the region of the vertical guide surface of the guide rib 9. In this way, it is reliably ensured that tilting of the anchor ring 13 is reliably ruled out during the bouncing process. It can also be seen that the stop element 18 of the circumferential strip 14 has already passed the circumferential web 10A. However, the strip 14 does not have to expand uniformly like the circumferential web 17 of the anchor ring 13, but only in the short sections in which stop elements 18 are present (see FIG. 4). In addition, the previously mentioned recesses on the webs 10A and 10B (see FIG. 3) ensure this expansion remains as small as possible, since the stop elements 18 are positioned accordingly.

Figure 7A:
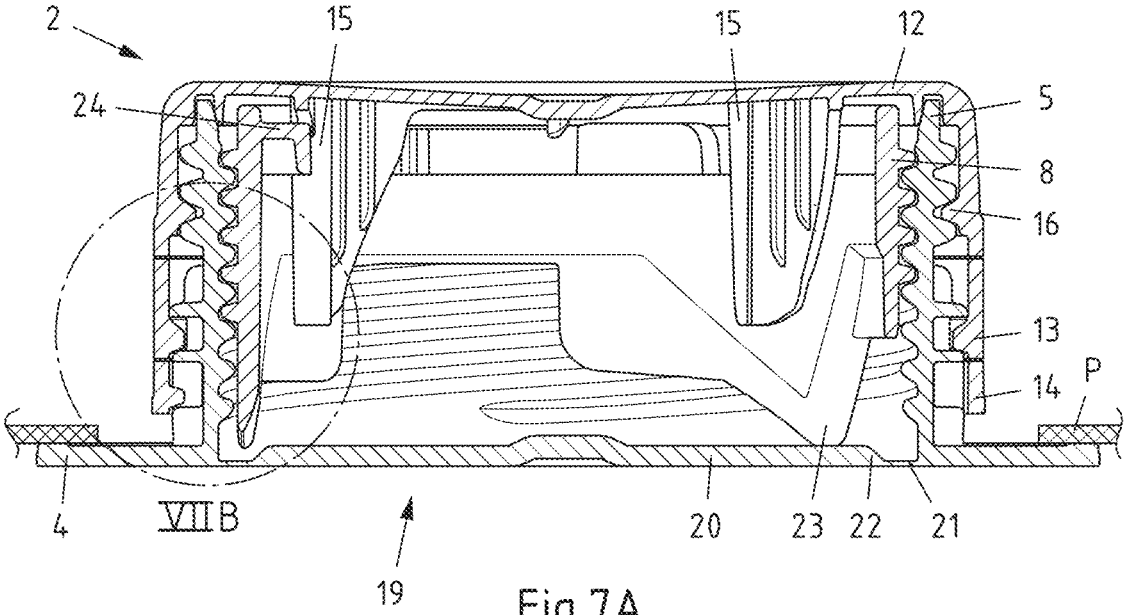
Figure 7B:
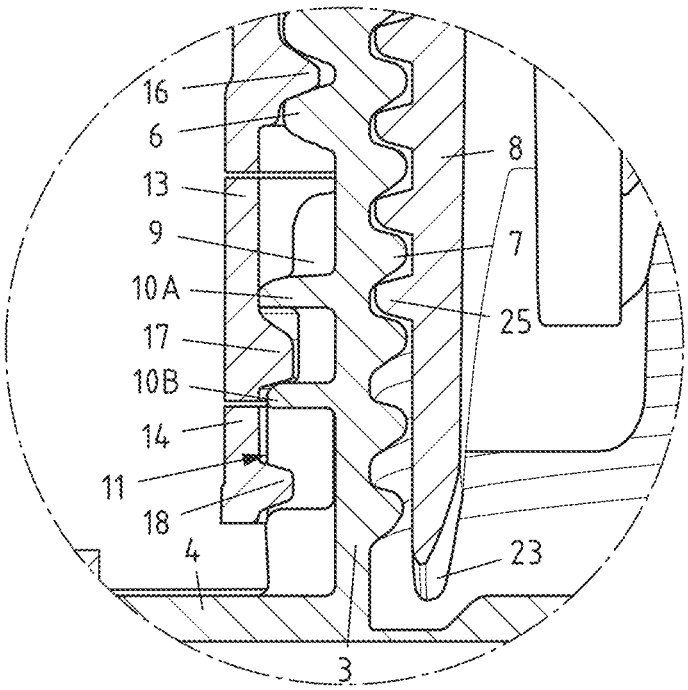

Finally, FIGS. 7A and 7B show the dispensing element 1 according to the invention in its fully assembled position. Between the screw cap 2 and the outer side of the spout 5 there is a first thread pair 6 and 16, which enables the screw cap 2 to be screwed on and tightened. The hollow cylindrical cutting element 8 with cutting teeth 23 is arranged inside the main body 3, which, when the dispensing element 1 and thus the composite package P is opened for the first time, separates the closure part 19 by destroying a partial section of the weakening zone 21. The vertical axis (not shown here) is defined by the concentrically arranged hollow cylindrical elements of the spout 5 and the cutting element 8. The cutting element 8 rotates about the vertical axis during the opening process and moves along this axis. This movement is defined by a second thread pair 7 and 25, which is located between the inner side of the spout 5 and the cutting element 8. In this movement, the cutting element 8 is driven by at least one force transfer element 24, which interacts with at least one corresponding force transmission element 15 of the screw cap 2.

LIST OF REFERENCE NUMERALS

1 Dispensing element
2 Screw cap
3 Main body
4 Flange
5 Spout
6 Outer thread
7 Inner thread
8 Cutting element
9 Vertical guide rib
10A Circumferential web
10B Web section
11 Locking element
12 Cover element
13 Anchor ring
14 Strip (tamper-proof seal)
15 Force transmission element
16 Inner thread
17 Retaining web
18 Stop element
19 Closure part
20 Central region
21 Annular weakening zone
22 Conical annular intermediate region
23 Cutting tooth
24 Force transfer element
25 Outer thread
Z Vertical axis
CL Circular line
P Composite package
S Slot
T Tether

The invention claimed is:

1. A resealable dispensing element for a composite package comprising a main body with a flange and a hollow cylindrical spout with at least one outer thread, an opening means guided movably in the spout for opening the composite package and a resealable screw cap, having an anchor ring, wherein the screw cap serves to drive the opening means when the composite package is opened for a first time, and wherein the screw cap and the anchor ring are connected by a plurality of breakable material bridges or at least by a material anchorage for connection to the main body, wherein the main body on the spout has at least one circumferential web for securely holding the anchor ring and wherein the anchor ring has on its inside a circumferential retaining web shaped such that it corresponds with the circumferential web, wherein the main body has a plurality of vertical guide ribs arranged distributed over the circumference on the spout between the outer thread and the circumferential web for uniformly stretching the anchor ring when the screw cap is applied during mounting of the dispensing element.

2. The dispensing element according to claim 1, wherein the overlap of the circumferential web and the circumferential retaining web is 0.5 to 0.7 mm with respect to the respective radius.

3. The dispensing element according to claim 1, wherein the upper edges of all lateral guide surfaces of the vertical guide ribs lie on a common circular line that is as large as the outer circumference of the outer thread.

4. The dispensing element according to claim 3, wherein the lateral guide surfaces run purely axially below the circular line up to the circumferential web.

5. The dispensing element according to claim 3, wherein the outer radius of the circumferential web is a maximum of 5% larger than the radius of the circular line.

6. The dispensing element according to claim 5, wherein the outer radius of the circumferential web is a maximum of 4% larger than the radius of the circular line.

7. The dispensing element according to claim 1, wherein the main body has at least six vertical guide ribs arranged distributed evenly over its circumference.

8. The dispensing element according to claim 7, wherein the main body has ten to twenty-four vertical guide ribs arranged distributed over its circumference.

9. The dispensing element according to claim 1, wherein a slot without material bridges is provided between the anchor ring and the cover element and in that the anchor ring has a tether connected in one piece to the cover element as a material anchorage.

10. The dispensing element according to claim 1, wherein a circumferential strip is provided below the anchor ring, which is connected to the anchor ring arranged above it via a plurality of breakable material bridges arranged distributed over the circumference and serves as a tamper-evident seal.

11. The dispensing element according to claim 10, wherein the circumferential strip has on its inside a plurality of stop elements arranged distributed over the circumference, which hook with vertical locking elements arranged correspondingly over the circumference of the main body when the screw cap is opened for first time, such that the material bridges break and visually indicate an opening of the composite package that has already taken place.

12. The dispensing element according to claim 11, wherein the circumferential web has recesses arranged distributed over its circumference, which in the assembled state of the dispensing element are in each case above the stop elements.

13. The dispensing element according to claim 11, wherein the vertical locking elements are arranged in an extension of the vertical guide ribs.

14. A method for mounting the screw cap for a dispensing element according to claim 1, characterised by the following steps:

grasping the screw cap around its circumference by means of a retaining device to achieve support around the entire 360° of the circumference, aligning the screw cap by rotating with respect to the main body, and moving the clamped screw cap and main body relatively axially until the end position is reached.

15. The method according to claim 14, wherein the retaining device has a cavity and in that the screw cap is moved axially into this cavity before the final assembly and is clamped after reaching the end position.

16. The method according to claim 15, wherein the screw cap is only clamped in axial regions without screw thread or webs from the outside.

* * * * *